US008313212B1

(12) United States Patent
Mayer et al.

(10) Patent No.: US 8,313,212 B1
(45) Date of Patent: Nov. 20, 2012

(54) MODULAR LIGHTING SYSTEM AND METHOD

(75) Inventors: Stanley Mayer, Middletown, NY (US); Patrick Fuchs, Hyde Park, NY (US); Donald L. Wray, Ocala, FL (US)

(73) Assignee: USAI, LLC, New Windsor, NY (US)

( * ) Notice: Subject to any disclaimer, the term of this patent is extended or adjusted under 35 U.S.C. 154(b) by 365 days.

(21) Appl. No.: 12/791,325

(22) Filed: Jun. 1, 2010

Related U.S. Application Data

(60) Provisional application No. 61/182,540, filed on May 29, 2009.

(51) Int. Cl.
*F21S 4/00* (2006.01)

(52) U.S. Cl. ... 362/219; 362/221; 362/225; 362/217.13; 362/217.17

(58) Field of Classification Search ..... 362/219, 362/221, 225, 217.13, 217.17
See application file for complete search history.

(56) References Cited

U.S. PATENT DOCUMENTS

| | | | | |
|---|---|---|---|---|
| 6,702,453 | B2 * | 3/2004 | Weedon | 362/219 |
| 7,703,941 | B2 * | 4/2010 | Lee | 362/219 |
| 2003/0223233 | A1 * | 12/2003 | Calzaretta et al. | 362/219 |
| 2008/0094828 | A1 * | 4/2008 | Shao | 362/219 |

OTHER PUBLICATIONS

DanaLite; "Architectural Linear Lighting"; Juno Lighting Group by Schneider Electric; www.junolightinggroup.com; Jan. 18, 2010; 18 pages.

* cited by examiner

*Primary Examiner* — Stephen F Husar
*Assistant Examiner* — James Cranson, Jr.
(74) *Attorney, Agent, or Firm* — St. Onge Steward Johnston & Reens LLC

(57) ABSTRACT

A modular lighting system has first, second and third lighting fixtures adapted for end-to-end electrical interconnection. The lighting fixtures are mounted to a support structure in a closely abutting relationship with the longitudinal axes thereof in alignment. First and second electrical inter-connector are removably connected to the first and second lighting fixtures and the second and third lighting fixtures, respectively. The first and second electrical inter-connectors are connectable and disconnectable from a top of the lighting fixtures without dismounting the lighting fixtures, and the second lighting fixture intermediate the other two lighting fixtures being dismountable from the support structure without dismounting the other two lighting fixture by removing the first and second electrical inter-connectors from the top of the lighting fixtures.

9 Claims, 18 Drawing Sheets

MODULAR LIGHTING SYSTEM AND METHOD

CROSS-REFERENCE TO RELATED APPLICATIONS

The present application claims the benefit under 35 U.S.C. §119(e) of the U.S. Provisional Patent Application Ser. No. 61/182,540, filed on May 29, 2009, the content of which is incorporated herein by reference.

FIELD OF THE INVENTION

This invention pertains to the field of modular lighting systems, and, in particular, to modular lighting systems having a number of elongated, lighting fixtures adapted for electrical interconnection in an end-to-end fashion.

BACKGROUND OF THE INVENTION

It is known to use modular lighting systems to illuminate extended areas, such as within a display case or underneath a shelf or in a cove. Such prior modular lighting systems, which are sometimes referred to as linear lighting systems, typically include a number of elongated lighting fixtures which can be mounted to a surface or support structure, and which are electrically interconnected in an end-to-end fashion in a string or "daisy chain", often in straight line segments. A power source is typically connected to a lighting fixture at the end of the string, which passes electrical power to all of the other lighting fixtures. A lighting installation having a length suitable for a particular situation can be achieved by combining a number of lighting fixtures in a string to create a lighting installation of an appropriate total length. An installation may include several spaced-apart illumination segments electrically connected together in a string, with each segment including several closely-spaced lighting fixtures, to create several separate areas of illumination, such as for a number adjacent display cases or shelves, or the like.

Each lighting fixture of such prior systems typically includes an illumination source designed to attempt to achieve a substantially even level of illumination over the length of the lighting fixture, such as an elongated fluorescent light source, or a number of individual light-emitting diode (LED) light sources spaced at intervals along a length of the lighting fixture. The lighting fixtures may include a light diffuser or other optical elements deigned to attempt to produce an even level of illumination along the length of the lighting fixture.

In prior art systems, the lighting fixtures are electrically interconnected using an axial inter-connector having two male portions extending outwardly in opposite directions from either side of a central separator portion of the inter-connector. Each male portion is received in a female recess in the end of an adjacent lighting fixture and is inserted therein in a direction in-line with or along the long axis of the lighting fixture. The central separator portion of the inter-connector is disposed between the adjacent lighting fixtures and requires that the lighting fixtures be separated from one another at least at a minimum spacing distance to accommodate the presence of the inter-connector between the lighting fixtures.

To assemble a string of such prior art lighting fixtures at the minimum spacing distance, a first lighting fixture is fixed to a support structure, for example within a display case. Then, an inter-connector is inserted axially into an end of the first lighting fixture. Then, a second lighting fixture is mated with the inter-connector, in the same, axial direction, with the central portion of the inter-connector located between and separating the first and second lighting fixtures. Once the second lighting fixture is mated with the inter-connector, the lighting fixture may be fixed to the support structure. To add a third lighting fixture, another inter-connector is inserted axially into the other end of the second lighting fixture. The third lighting fixture is mated to that inter-connector and then fixed to the support structure. As can be appreciated, instead of fixing the lighting fixture to the support structure one-by-one, as described above, the lighting fixtures and inter-connectors can be assembled prior to mounting, and then mounted together as a unit to the support structure. In any case, however, in order to remove and replace a lighting fixture located between two other lighting fixtures arranged at the minimum spacing distance, or to remove and replace any inter-connectors of such an arrangement, it is necessary to remove one or both of the adjacent lighting fixtures, and, in some cases, it is necessary to remove all of the lighting fixtures.

Illumination needs sometimes change after lighting systems are installed, and, while lighting systems are usually designed to last many years, lighting fixtures and inter-connectors sometime fail or require replacement. With the prior lighting systems it is difficult or impossible to replace a lighting fixture located between two adjacent lighting fixtures or to replace an inter-connector between lighting fixtures, when the lighting fixtures are mounted at the minimum spacing distance, without removing or damaging the lighting fixtures on either side, or, in some cases, without removing all of the other lighting fixtures. Installations of such lighting systems, especially in commercial environments, can include a large number of individual lighting fixtures (for example 20 or more) and can extend over a large distance (for example 20 to 100 ft or more). Therefore, the effort and cost of replacing individual lighting fixtures, or replacing or modifying inter-connectors, in such prior systems is significant and has been a deterrent to their adoption and use.

A goal of such lighting systems is to provide a substantially even level of illumination along the entire length of the entire installation (or at least along each illumination segment) to avoid significant or noticeable "dark spots" between lighting fixtures. A technique to avoid or minimize such dark spots between adjacent lighting fixtures is to mount adjacent lighting fixtures as close to one another as feasible. However, such prior art lighting systems can include dark spots between lighting fixtures because portions of the inter-connectors of the prior systems are located between adjacent lighting fixtures and require that the lighting fixtures be spaced apart from one another at an undesirably large spacing distance to accommodate the presence of the central portion of the inter-connector.

Therefore, what is desired is a modular lighting system having a number of individual, elongated lighting fixtures electrically inter-connectable in an end-to-end fashion where a lighting fixture within a string of lighting fixtures arranged at a minimum spacing distance, or an inter-connector between such lighting fixtures, can be removed and replaced, without damaging or removing any of the other lighting fixtures in the installation regardless of how many lighting fixtures are interconnected and regardless of the total length of the installation, to reduce the time and cost required to perform modifications and repairs of such lighting systems. Furthermore, what is desired is such a modular lighting system where adjacent lighting fixtures can be electrically interconnected without requiring that the lighting fixtures be spaced apart from one another, to avoid dark spots between adjacent lighting fixtures to provide an even level of illumination.

SUMMARY OF THE INVENTION

Accordingly, it is an object of the present invention to provide a modular lighting system having a number of individual, elongated lighting fixtures electrically inter-connectable in an end-to-end fashion where a lighting fixture within a string of lighting fixtures arranged at a minimum spacing distance can be removed and replaced, without damaging or removing any of the other lighting fixtures in the installation regardless of how many lighting fixtures are interconnected and regardless of the total length of the installation.

It is a further object of the present invention to provide a modular lighting system having a number of individual, elongated lighting fixtures electrically inter-connectable in an end-to-end fashion where an inter-connector between a string of lighting fixtures arranged at a minimum spacing distance can be removed and replaced, without damaging or removing any of the lighting fixtures in the installation regardless of how many lighting fixtures are interconnected and regardless of the total length of the installation.

It is another object of the present invention to provide a modular lighting system where adjacent lighting fixtures can be electrically interconnected without requiring that the lighting fixtures be spaced apart from one another, to avoid dark spots between adjacent lighting fixtures to provide an even level of illumination.

These and other objectives are achieved by providing a modular lighting system having first and second lighting fixtures adapted for end-to-end electrical interconnection, where each lighting fixture includes first and second ends, at least one electrical connector adjacent each of the first and second end, means for illumination, and a longitudinal axis passing through the first and second end. The first and second lighting fixtures are mounted to a support structure with the longitudinal axes thereof in alignment and with one of the ends of the first lighting fixture closely abutting one of the ends of the second lighting fixture. A first electrical inter-connector is removably connected to the first and second lighting fixtures and electrically interconnects at least one of the electrical connectors of the first lighting fixture to at least one of the electrical connectors of the second lighting fixture. The first electrical inter-connector is connectable to and disconnectable from the first and second lighting fixtures without dismounting the first and second lighting fixtures from the support structure.

In some embodiments, the system has a third lighting fixture adapted for end-to-end electrical interconnection, the third lighting fixture includes first and second ends, at least one electrical connector adjacent each of the first and second ends, means for illumination, and a longitudinal axis passing through the first and second ends. The third lighting fixture is mounted to the support structure with the longitudinal axis thereof in alignment with the longitudinal axes of the first and second lighting fixtures and with one of the ends of the third lighting fixture closely abutting one of the ends of the second lighting fixture, such that the second lighting fixture is intermediate the first and third lighting fixtures. A second electrical inter-connector is removably connected to the second and third lighting fixtures and electrically interconnects at least one of the electrical connectors of the second lighting fixture to at least one of the electrical connectors of the third lighting fixture. The second electrical inter-connector is connectable to and disconnectable from both of the second and third lighting fixtures without disturbing the second or third lighting fixtures. Upon disconnection of the first electrical inter-connector from the first and second lighting fixtures and the second electrical inter-connector from the second and third lighting fixtures, the second lighting fixture is dismountable from the support structure without dismounting the first or third lighting fixtures.

Other objects of the present invention are achieved by provision of a modular lighting system having first and second lighting fixtures adapted for end-to-end electrical interconnection, where each lighting fixture includes first and second ends, at least one electrical connector adjacent each of the first and second ends, means for illumination, and a longitudinal axis passing through the first and second ends. A first electrical inter-connector is removably connected to the first and second lighting fixtures and electrically interconnects at least one of the electrical connectors of the first lighting fixture to at least one of the electrical connectors of the second lighting fixture. The first electrical inter-connector is connectable to at least one of the first and second lighting fixtures by moving the electrical inter-connector relative to the one lighting fixture in a first direction substantially perpendicular to the longitudinal axis of the one lighting fixture.

In other embodiments, each lighting fixture has a base defining a mounting plane and the first direction is substantially normal to the mounting plane.

In other embodiments, the longitudinal axis and the mounting plane are substantially parallel.

In other embodiments, the first and second lighting fixtures are mounted to the support structure with the longitudinal axes thereof in alignment and with one of the ends of the first lighting fixture closely abutting one of the ends of the second lighting fixture, and the first electrical inter-connector is disconnectable from both of the first and second lighting fixtures without disturbing the first or second lighting fixtures.

In other embodiments, the modular lighting system includes a third lighting fixture adapted for end-to-end electrical interconnection. The third lighting fixture includes first and second ends, at least one electrical connector adjacent each of the first and second ends, means for illumination, a longitudinal axis passing through the first and second ends, a base defining a mounting plane, and the mounting plane of the base and the longitudinal axis being substantially parallel. The third lighting fixture is mounted to the support structure with the longitudinal axis thereof in alignment with the longitudinal axes of the first and second lighting fixtures and with one of the ends of the third lighting fixture closely abutting one of the ends of the second lighting fixture, such that the second lighting fixture is intermediate the first and third lighting fixtures. A second electrical inter-connector is removably connected to the second and third lighting fixtures and electrically interconnects at least one of the electrical connectors of the second lighting fixture to at least one of the electrical connectors of the third lighting fixture. The second electrical inter-connector is connectable to the second and third lighting fixtures by moving the electrical inter-connector relative to the second and third lighting fixtures in a direction substantially parallel to the first direction. The second electrical inter-connector is disconnectable from both of the second and third lighting fixtures without disturbing the second or third lighting fixtures. Upon disconnection of the first electrical inter-connector from the first and second lighting fixtures and the second electrical inter-connector from the second and third lighting fixtures, the second lighting fixture is dismountable from the support structure without dismounting the first or third lighting fixtures.

In other embodiments, each of the first and second lighting fixtures has a plurality of illumination elements disposed along a longitudinal length of the lighting fixture, with the illumination elements spaced apart a predetermined spacing interval. The first lighting fixture has an end-most illumination element closest to the second lighting fixture and the second lighting fixture has an end-most illumination element closest to the first lighting fixture. The first and second lighting fixtures are mounted to the support structure with the longitudinal axes thereof in alignment and with one of the ends of the first lighting fixture closely abutting one of the ends of the second lighting fixture. A distance between the end-most illumination element of the first lighting fixture and the end-most illumination element of the second lighting fixture being substantially equal to the spacing interval.

In other embodiments, the first lighting fixture has first and second illumination sub-assemblies and the first and second illumination sub-assemblies are electrically inter-connected by an intra-fixture connector within the first lighting fixture, in an end-to-end fashion. Each illumination sub-assembly has a plurality of illumination elements disposed along a longitudinal length thereof, with the illumination elements spaced apart a predetermined spacing interval. The first illumination sub-assembly has an end-most illumination element closest to the second illumination sub-assembly and the second illumination sub-assembly has an end-most illumination element closest to the first lighting fixture. A distance between the end-most illumination element of the first lighting fixture and the end-most illumination element of the second lighting fixture being substantially equal to the spacing interval.

Other objects of the invention and its particular features and advantages will become more apparent from consideration of the following drawings and accompanying detailed description.

BRIEF DESCRIPTION OF THE DRAWINGS

For a complete understanding of the features of the invention, reference shall be made in the following detailed description of the invention and to the accompanying drawings, wherein.

DETAILED DESCRIPTION OF THE INVENTION

Figure 1A:
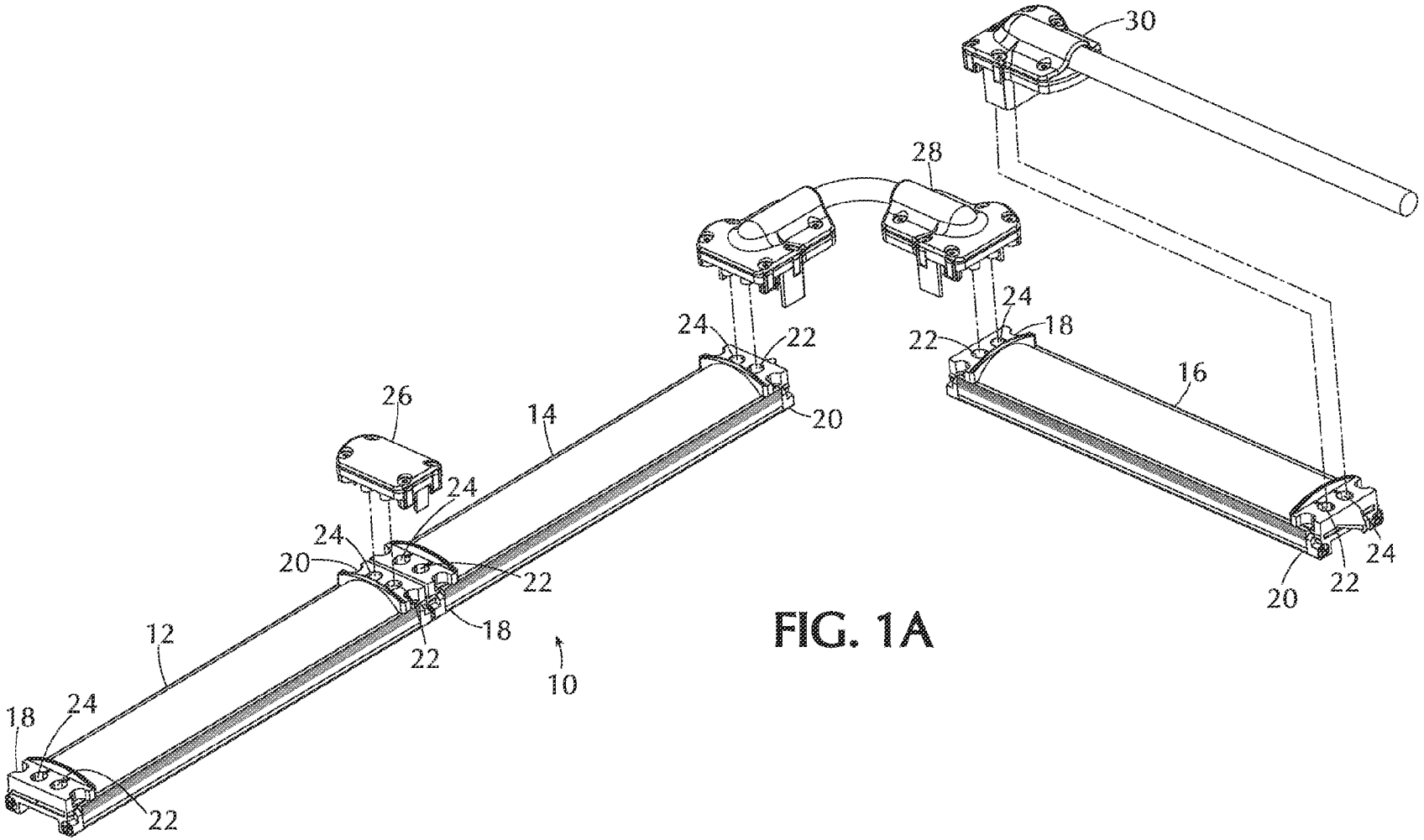
FIGS. 1A and 1B are perspective views of lighting systems constructed in accordance with the present invention.
Figure 1B:
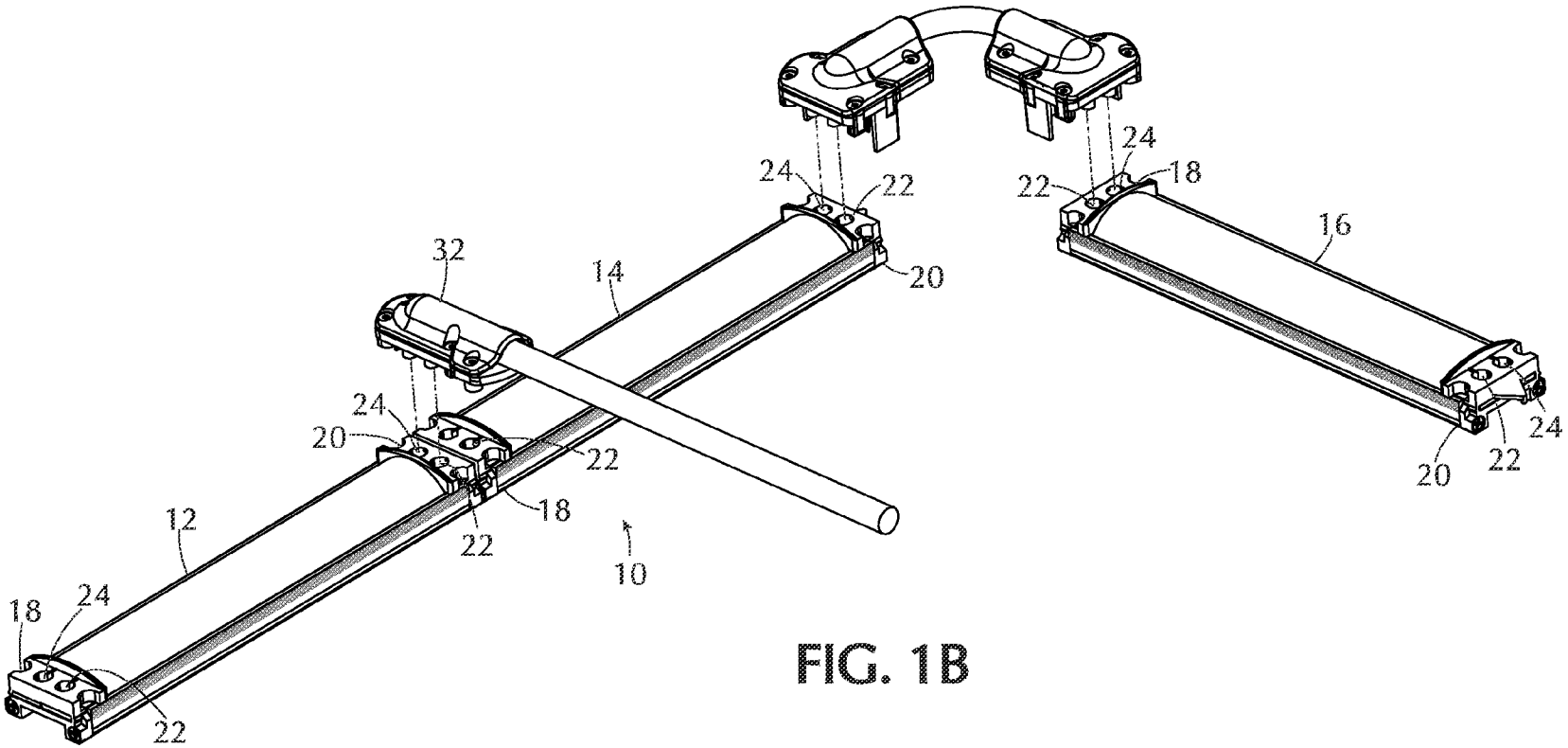

Referring to FIGS. 1A and 1B, a lighting system 10 constructed according to the invention includes a number of elongated lighting fixtures 12, 14, 16 adapted for electrical interconnection in an end-to-end fashion in a string or "daisy chain." The lighting fixtures 12, 14, 16 have first and second opposed ends 18, 20 and have electrical connectors 22, 24 adjacent each opposed end 18, 20. The lighting fixtures can be fixed to a support structure (not shown) such as within a display case, shelf, or cove, or another suitable support structure.

A power source, such as a low-voltage, direct current (DC) power source (not shown), or another suitable type or voltage-level power source, is connected to one of the lighting fixtures (preferably a lighting fixture at one at an end of the string), which passes power to all of the other lighting fixtures. Alternatively, an integrated power supply (not shown) could be enclosed within one of the lighting fixtures (for example an end-most lighting fixture), or within each lighting fixture.

A lighting installation having a length suitable for a particular situation can be achieved by combining a number of lighting fixtures in a string to create a lighting installation of an appropriate total length and configuration. An installation may include several spaced-apart illumination segments electrically connected together, with each segment including several closely-spaced lighting fixtures, to create several separate areas of illumination.

The lighting system includes several types of electrical inter-connectors. The lighting system includes a minimal spacing, in-line inter-connector 26, which can interconnect adjacent, closely-spaced lighting fixtures 12, 14 with minimal or no spacing between the lighting fixtures, for example with no gap or very minimal gap of about 0-10 mm between adjacent lighting fixtures.

The lighting system also includes a flexible inter-connector 28 for interconnecting adjacent lighting fixtures at various angles and orientations, an extended in-line inter-connector 30 for interconnecting lighting fixtures spaced a substantial distance apart (for example 1 meter or more), and a "mid feed" inter-connector 32 for interconnecting a lighting fixture to an intermediate portion of a string of lighting fixtures, which may be used, for example, to create a second branch off of a string of lighting fixtures.

Importantly, the minimal spacing, in-line inter-connector 26 is removably connected to the adjacent, closely-spaced lighting fixtures 12, 14 from the "top" of the lighting fixtures 12, 14, such that the inter-connector 26 can be connected and disconnected as needed without removing, dismounting, damaging or otherwise substantially disturbing the adjacent lighting fixtures or any other lighting fixtures in the string. In other words, there is no need to move the adjacent, closely spaced lighting fixtures 12, 14 in order to remove the minimal spacing, in-line inter-connector 26. Thus, such inter-connector 26 can be removed and replaced as desired without the need to disassemble or dismount any of the lighting fixtures. In addition, if it becomes necessary or desirable to replace a lighting fixture located between two other lighting fixtures mounted at the minimal spacing interval (i.e., no gap or minimal gap), such lighting fixture can be removed and replaced by first removing the minimal spacing, in-line inter-connector 26 on either end of the lighting fixture to be removed, and then simply removing and replacing the one lighting fixture. The lighting fixtures on either side need not be removed or otherwise disturbed.

The "mid feed" inter-connector 32 is removably connectable to adjacent lighting fixtures spaced at the minimal spacing distance (i.e., no gap or minimal gap) from the "top" of the lighting fixtures, in the same manner as the minimal spacing, in-line inter-connector 26. Thus, the "mid feed" inter-connector 32 can be connected and disconnected as needed without disturbing any of the lighting fixtures in the string. Furthermore, a minimal spacing, in-line inter-connector 26 can be replaced by a "mid feed" inter-connector 32 (or vice versa), without disturbing the adjacent lighting fixtures.

The flexible inter-connector 28 and the extended in-line inter-connector 30 are also configured to connect and disconnect from the lighting fixtures 12, 14, 16 from the "top", in the same manner as the minimal spacing, in-line inter-connector 26 and the "mid feed" inter-connector 32, such that the lighting fixtures can be arranged in a wide variety of configurations to accommodate various lighting requirements.

Referring to FIGS. 2, 3 and 4A-4C, each lighting fixture 12 preferably includes an elongated base 40 having first and second ends 42, 44 adjacent the ends 18, 20 of the lighting fixture 12. The base 40 is preferably integrally formed from extruded metal, such as extruded aluminum, but can be formed from other materials and by other methods. The base 40 is configured to fixedly mount the lighting fixture to a preferably planar mounting surface of a support structure (not shown), such as within a display case or shelf or another suitable location.

The lighting fixture 12 has a longitudinal axis (Z) that passes through each end 18, 20 of the lighting fixture. When the lighting fixture is affixed to the mounting surface of the support structure, the longitudinal axis (Z) of the lighting fixture is preferably substantially parallel to a plane of the mounting surface, and a normal axis (Y) is normal to the plane of the mounting surface and perpendicular to the longitudinal axis (Z). A lateral axis (X), is orthogonal to the (Z) and (Y) axes, and a plane defined by the (Z) and (X) axes is preferably parallel to the plane of the mounting surface.

The base 40 supports an illumination source 46 comprising one or more illumination elements 48 disposed along the length of the lighting fixture 12, such as an elongated fluorescent bulb, or spaced-apart LED lighting elements (as depicted), or another suitable type of illumination source or elements. A lens or cover 52 is disposed over the illumination source 46. The electrical connectors 22, 24 disposed adjacent each end 18, 20 of the lighting fixture 12 preferably comprise male pin connectors 52, 54 that extend upwardly away from the base 40 in a direction parallel to the normal axis (Y). Alternatively, the electrical connectors 22, 24 can comprise or include one or more female connectors (not shown) adapted to receive a male connector inserted therein in a direction parallel to the normal axis (Y).

Each end 18, 20 of the lighting fixture 12 is preferably terminated by an end cap 56 which can be formed of injection molded plastic or another suitable material or method. Each end cap 56 preferably includes a mounting portion 58 adapted to abut and connect to an end face 60 of the base 40, such as via screws 62 or other suitable fasteners. The end cap 56 also preferably includes a cover portion 64 extending from the mounting portion 58 in a cantilever fashion and configured to extend over and cover the associated end portion 42, 44 of the base 40. Each cover portion 64 preferably includes a number of contact openings 66, 68 therethrough, each of which receives and shrouds one of the electrical connectors 22, 24. The contact openings 66, 68 provide access to the electrical contacts 22, 24 from the "top" of the lighting fixture 12 in a direction parallel to the normal axis (Y), such that the inter-connectors of the system can be connected to the lighting fixture without disturbing adjacent lighting fixtures.

Figure 5:
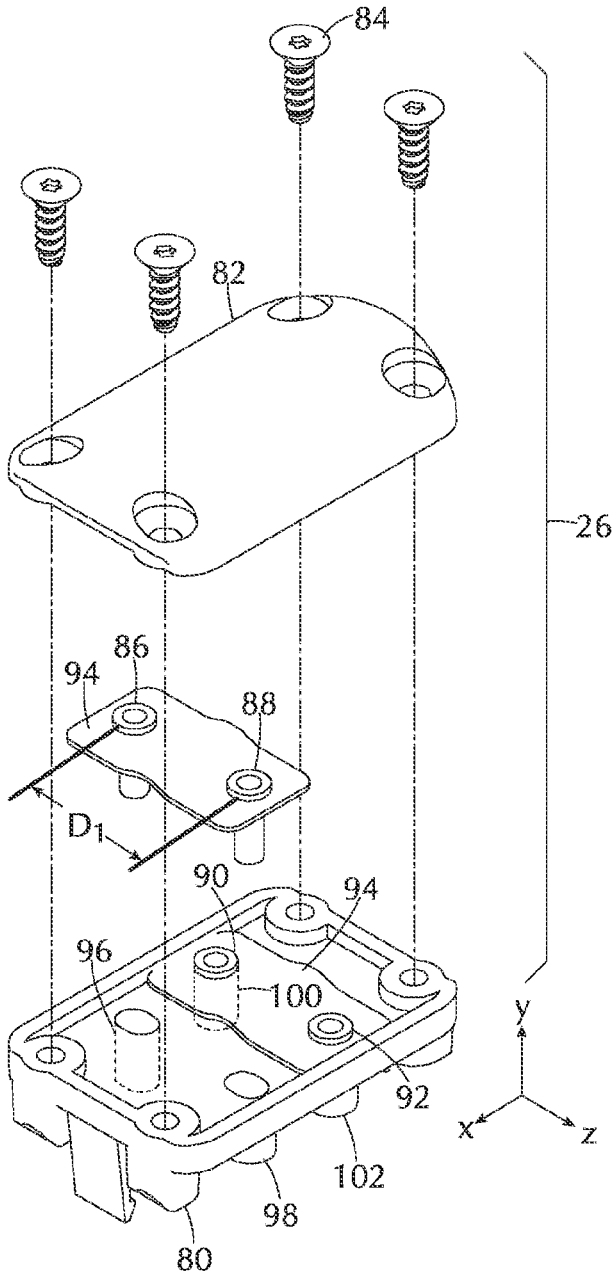
FIG. 5 is an exploded, perspective view of an inter-connector of the lighting system of FIG. 1A.
Figure 6:
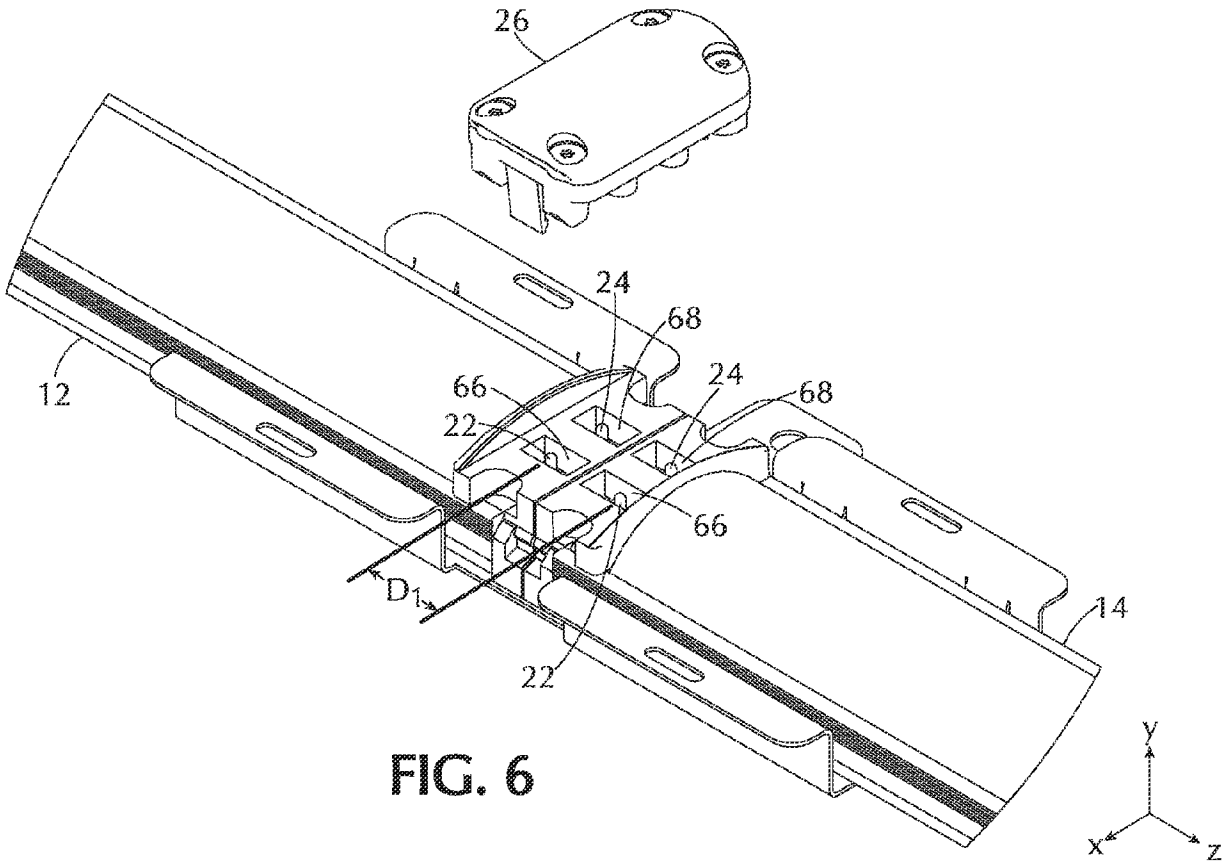
FIG. 6 is a partial, perspective view of two lighting fixtures connected by an minimal spacing, in-line inter-connector.

Referring to FIGS. 5 and 6, the minimal spacing, in-line inter-connector 26 has a base part 80 and a cover part 82, which parts can be assembled by screws 84 or other suitable fasteners. The inter-connector 26 includes first and second pairs of electrical connectors 86, 88 and 90, 92, which are preferably female-type connectors. The electrical connectors of each pair 86, 88 and 90, 92 can be interconnected by a flexible printed circuit board 94 as depicted, or any other suitable means to electrically interconnect the paired connectors.

The base part 80 of the inter-connector 26 includes first and second pairs of preferably hollow or tubular connector shrouds 96, 98 and 100, 102 extending downwardly from a bottom of base part 80 and configured to receive, surround and shroud preferably the entire length of the connectors of the first and second pairs of electrical connectors 86, 88 and 90, 92. The connector shrouds 96, 98 and 100, 102 are arranged and configured to be received within the contact openings 66, 68 of the end caps 56 of the lighting fixture 12 such that the electrical connectors 86, 88 and 90, 92 within the connector shrouds 96, 98 and 100, 102 can electrically engage the electrical connectors 22, 24 of the lighting fixture.

When two lighting fixtures are mounted in-line (i.e., with the longitudinal (Z) axes aligned), with adjacent ends 18, 20 thereof at the minimal spacing distance (such as lighting fixtures 12, 14 in FIGS. 1A and 1B), the lighting fixtures are in a closely abutting relationship and there is preferably no gap or a minimal gap (for example 0-10 mm) between the ends 18, 20 of the lighting fixtures 12, 14. When in such an arrangement, the lighting fixtures 12, 14 can be interconnected using the minimal spacing, in-line inter-connector 26. As discussed above, the inter-connector 26 can be installed and removed from the "top" of the lighting fixtures 12, 14 in a direction parallel to the normal axis (Y). When installed, the inter-connector 26 electrically connects opposed pairs of electrical contacts 22-22 and 24-24 to provide power between the lighting fixtures.

Preferably, when the inter-connector 26 is installed, no portion of the inter-connector 26 is disposed between the adjacent lighting fixtures 12, 14. Thus, the lighting fixtures can be arranged in a closely abutting relationship (i.e. no gap or minimal gap), which avoids dark spots between lighting fixtures.

The centers of the connectors of each pair of electrical connectors 86, 88 and 90, 92 of the inter-connector 26 (and the centers of the shrouds of each pair of connector shrouds 96, 98 and 100, 102 thereof) are spaced apart a longitudinal (i.e., Z-axis) distance ($D_1$) (the connector span distance) which is equal to a longitudinal distance ($D_1$) between opposed electrical connectors 22-22 and 24-24 of adjacent lighting fixtures 12, 14, when the lighting fixtures 12, 14 are mounted in-line with adjacent ends 18, 20 thereof at the minimal spacing distance.

Referring again to FIG. 2, the illumination elements 48 are preferably disposed along or parallel to the longitudinal axis (Z) of the lighting fixture 12 and are spaced from each other at a regular spacing interval (S). The two end-most illumination elements 48 are spaced from the adjacent electrical contacts 22, 24 at a longitudinal (Z-axis) distance ($D_2$) (the end spacing distance), which is less than the connector span distance ($D_1$). The spacing interval (S) is equal to the connector span ($D_1$) plus twice the end spacing distance ($D_2$), or in mathematical terms, [$S=D_1+2\times D_2$]. This configuration promotes a consistent spacing between all illumination elements 48 in a string of multiple lighting fixtures to provide for an even level of illumination along an entire string of lighting fixtures.

The lighting fixture 12 preferably includes at least one illumination sub-assembly 110 including a preferably rigid, elongated substrate 112, for example a rigid printed circuit board (PCB). The illumination sub-assembly also includes the illumination elements 48, for example LEDs, mounted to the substrate 112, and the electrical contacts 22,24, which are mounted to the substrate 112 adjacent opposite ends 114, 116 thereof. Where the substrate 112 is a PCB, the illumination elements 48 and the electrical contacts 22, 24 can be surface mounted thereto. The illumination sub-assembly 110, and in particular, the substrate 112, preferably includes or supports electronic components 118 for the illumination elements 48 and circuitry (not shown) for the sub-assembly and for passing power to other sub-assemblies and other lighting fixtures.

Figure 7:
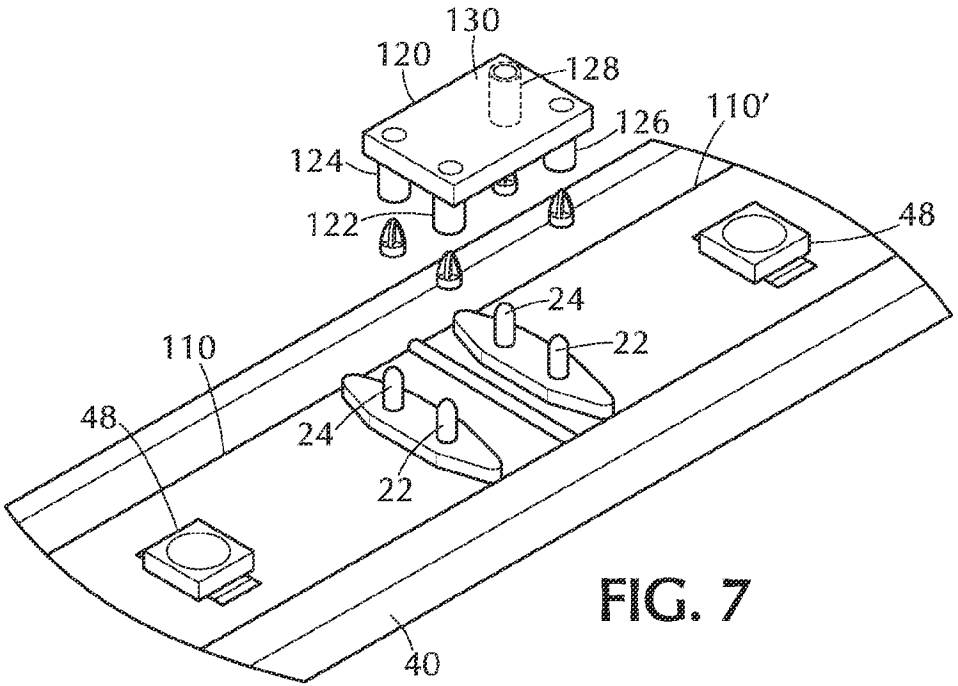
FIG. 7 is an exploded, partial perspective view of a lighting fixture constructed in accordance with the invention showing a intra-fixture connector joining two PCB boards within the lighting fixture.
Figure 8:
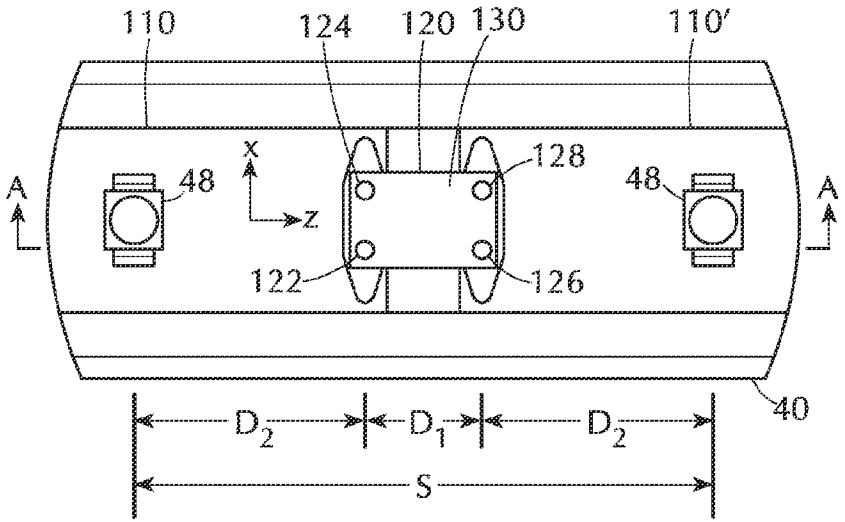
FIG. 8 is a partial top plan view of the lighting fixture of FIG. 7.
Figure 9:
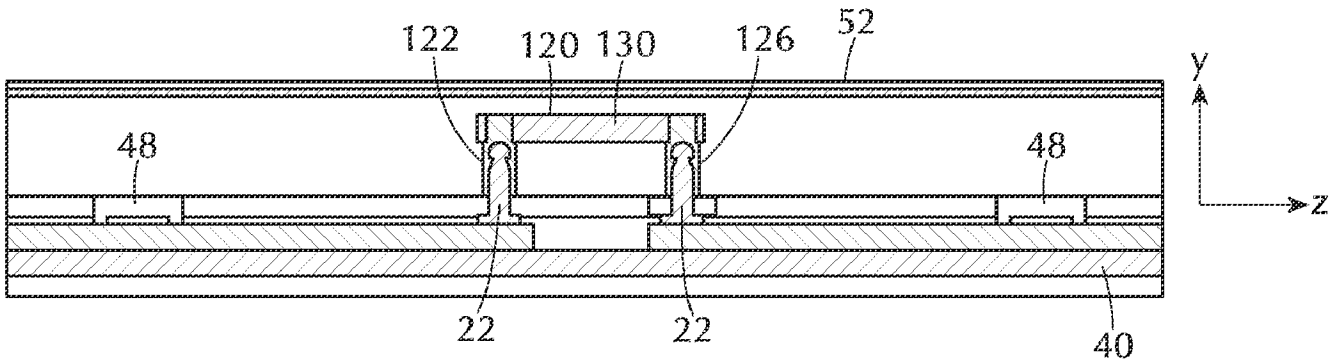
FIG. 9 is cross sectional, elevation view showing the intra-fixture connector of FIG. 7.

Referring to FIGS. 7-9, to create a lighting fixture of a greater length, multiple (preferably identical) illumination sub-assemblies 110, 110' of predetermined (and preferably identical) length can be interconnected in an end-to-end, daisy-chain fashion within the lighting fixture 12, and the base 40 can be provided at an extended length as required to accommodate the combined length of the several sub-assemblies. Adjacent sub-assemblies 110, 110' within the lighting fixture are electrically interconnected via an intra-fixture connector 120, which has first and second pairs of electrical connectors 122, 124 and 126, 128, which are preferably female-type connectors configured to connect to the electrical contacts 22, 24 of each of the adjacent illumination sub-assemblies 110, 110'. The function of the intra-fixture connector 120 is similar to the function of the minimum spacing, in-line inter-connector 26 described above, at least with respect to electrical interconnection. In addition to providing electrical interconnections, the intra-fixture connector 120 also serves to mechanically connect the adjacent illumination sub-assemblies 110,110'.

The intra-fixture connector 120 preferably includes a preferably substantially rigid substrate 130 and the electrical connectors 122, 124 and 126, 128 of the connector 120 are mounted perpendicular to and extend downwardly (Y-axis) from the substrate 130. When the lighting fixture 12 is fully assembled, the cover 52 preferably covers and conceals the intra-fixture connector 120, and the intra-fixture connector 120 preferably has a low profile such that it will not interfere with the proper attachment of the cover 52 to the base 40.

As described above, the illumination elements 48 in each illumination sub-assembly 110, 110' are preferably spaced at a regular spacing interval (S) and the two end-most illumination elements 48 are spaced from the adjacent electrical contacts 22, 24 at a longitudinal distance ($D_2$) equal to the end spacing distance ($D_2$). A connector distance ($D_1$) between centers of the electrical connectors of each pair of electrical connectors 122, 124 and 126, 128 of the intra-fixture connector 120 is substantially equal to the connector distance ($D_1$), as described above with respect to the minimal spacing, in-line inter-connector 26. The spacing interval (S) is equal to the connector distance ($D_1$) plus twice the end spacing distance ($D_2$), that is [$S=D_1+2\times D_2$]. Thus, when several illumination sub-assemblies 110, 110' are interconnected within a single lighting fixture, the spacing interval (S) between illumination elements 48 remains substantially constant along the entire length of the lighting fixture to provide a consistent illumination level over the length of the lighting fixture.

Figure 2:
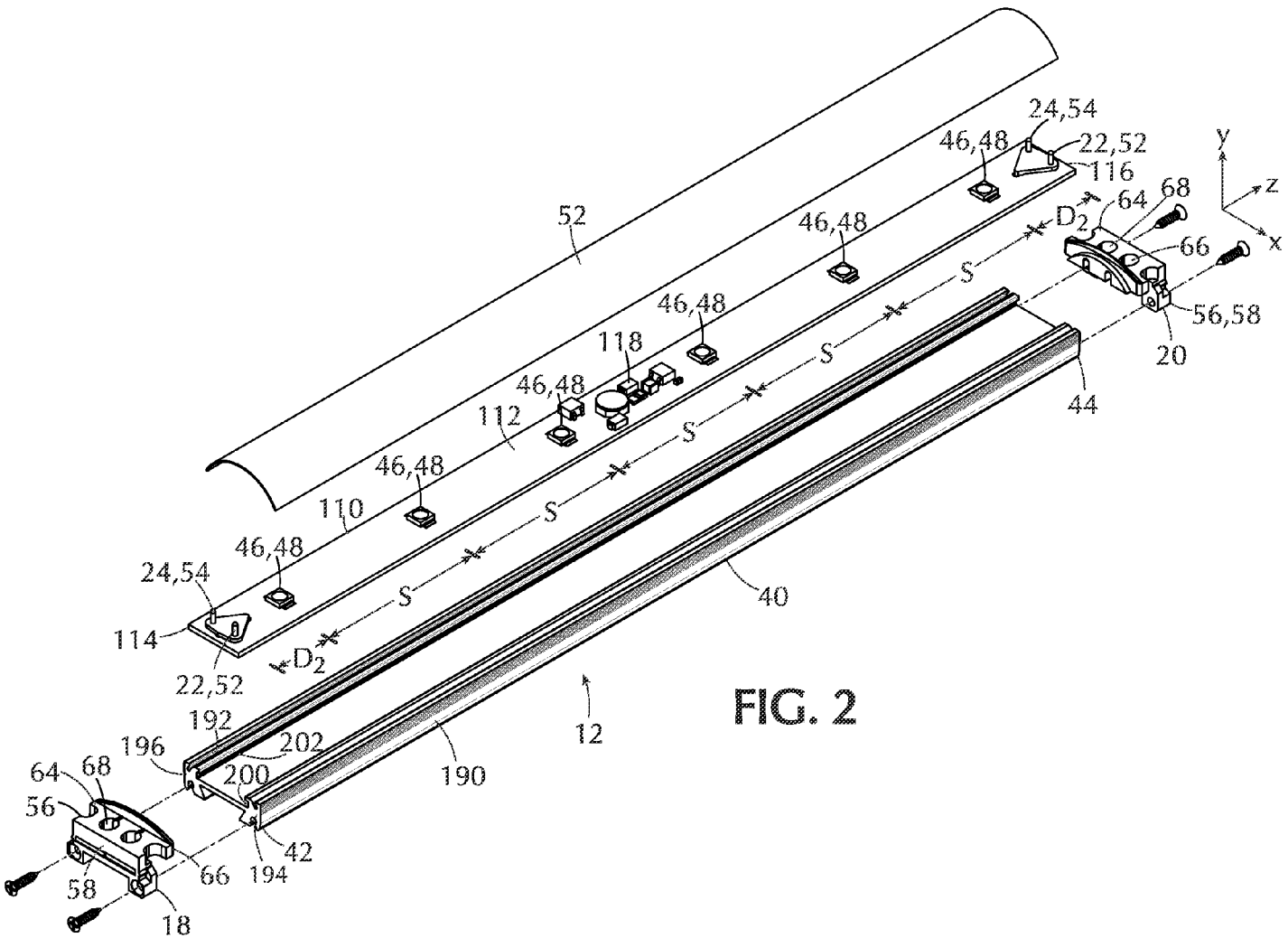
FIGS. 2 and 3 are exploded, perspective views of a lighting fixture constructed in accordance with the present invention.
Figure 3:
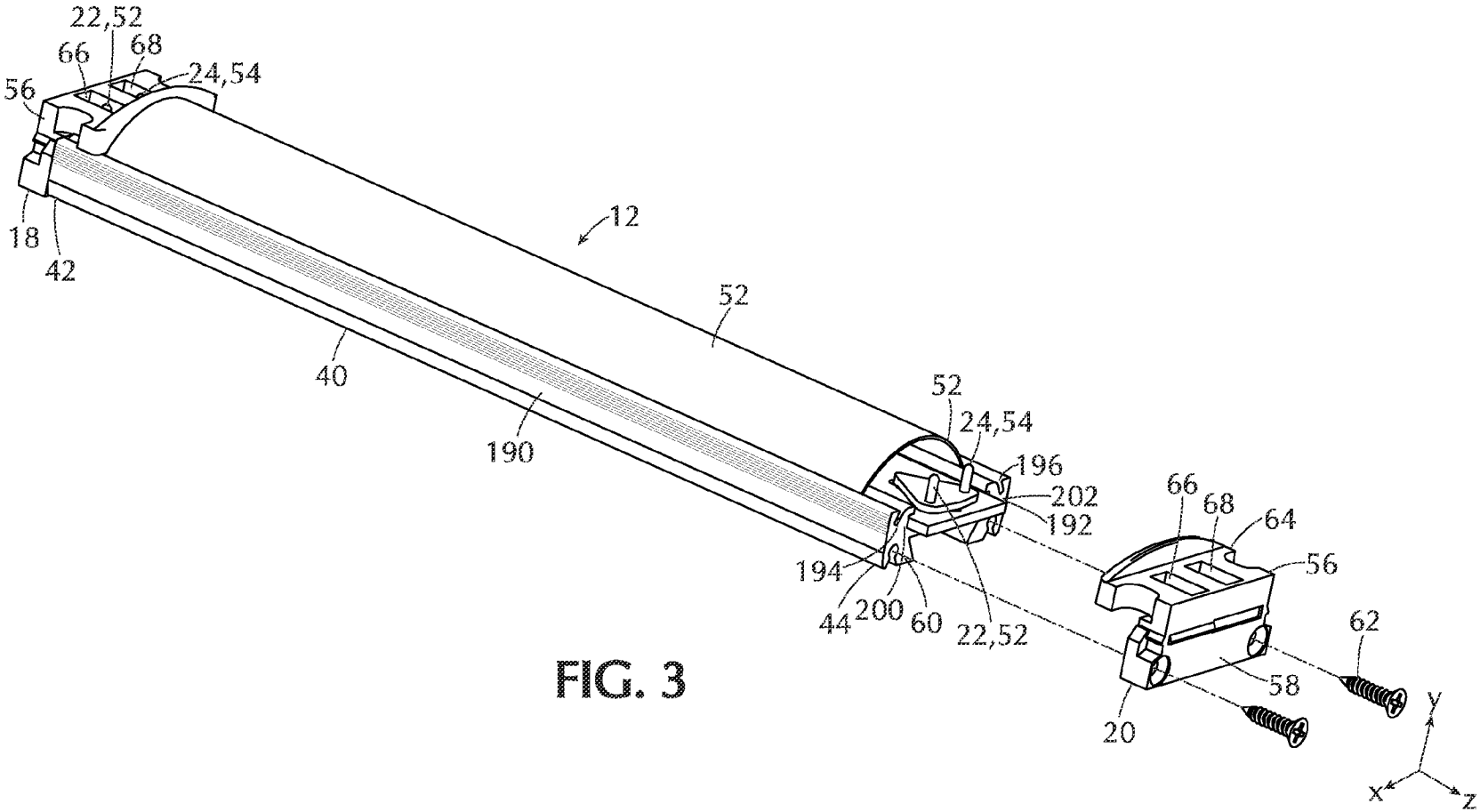
Figure 4A:
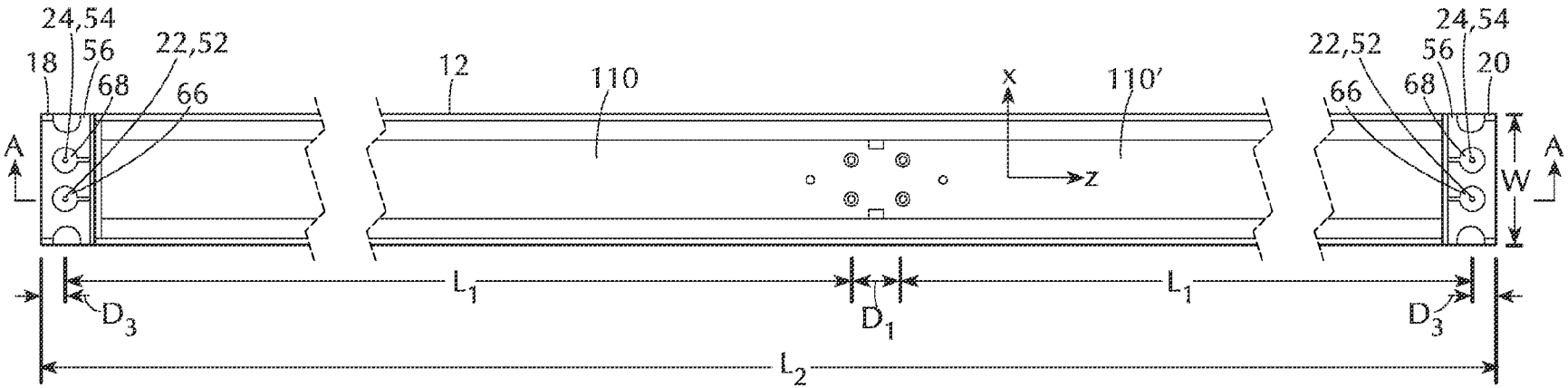
FIG. 4A is a partial plan view of a lighting fixture having two interconnected illumination sub-assemblies.
Figure 4B:
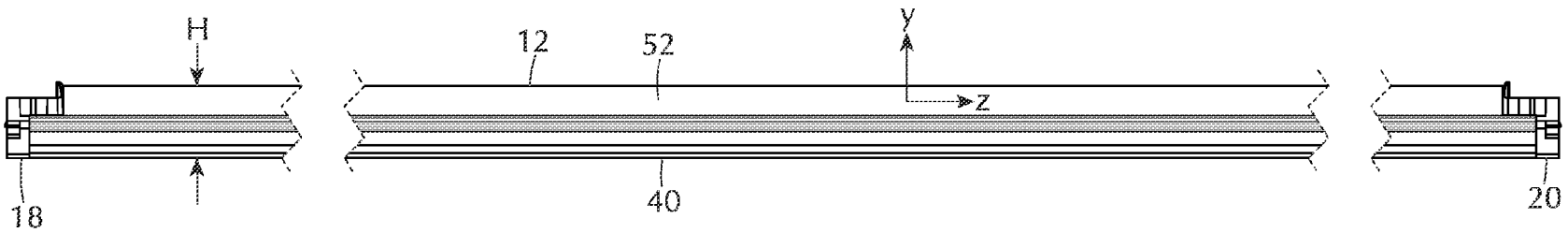
FIG. 4B is a partial side elevation view of the lighting fixture of FIG. 4A.
Figure 4C:
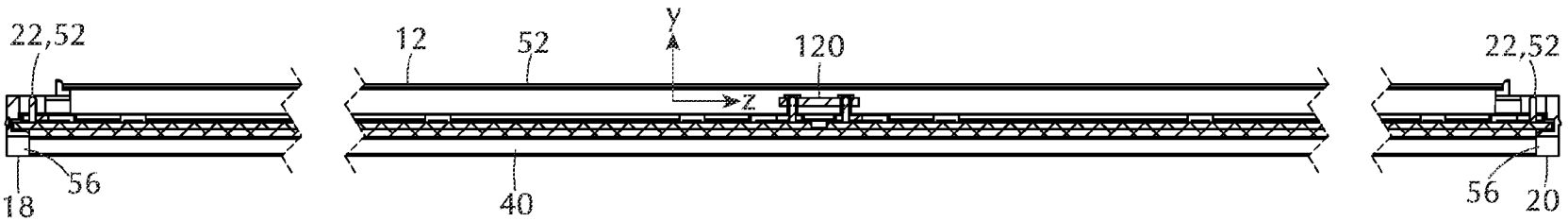
FIG. 4C is a partial cross-sectional elevation view, taken along line A-A of FIG. 4A.

Referring to FIGS. 2 and 4A, the electrical contacts 22, 24 adjacent one end of 114 the illumination sub-assembly 110 are preferably spaced from the electrical contacts 22, 24 adjacent the other end 116 of the sub-assembly 110 a longitudinal (Z-axis) distance ($L_1$) equal to twice the end spacing distance ($D_2$) plus the product of a number (N) of evenly-spaced illumination elements 48 less one (1) and the spacing interval (S), or [$L_1=2\times D_2+(N-1)\times S$].

A longitudinal distance ($D_3$) between the electrical contacts 22, 24 and the adjacent end 18, 20 of the lighting fixture 12 (the end distance) is equal to one-half the difference between ($D_1$) and a gap (G) between lighting fixtures interconnected by the minimal spacing, in-line inter-connector 26, or [$D_3=\frac{1}{2}(D_1-G)$].

An overall, end-to-end longitudinal (Z-axis) length ($L_2$) of a lighting fixture having any number (n) of illumination sub-assemblies 110 of equal longitudinal dimensions is equal to the product of (n) and ($L_1$), plus the product of (n) less one (1) and ($D_1$), plus twice the end distance ($D_3$), or [$L_2=n\times L_1+(n-1)\times D_1+2\times D_3$]. Thus, where the lighting fixture contains one illumination sub-assembly (n=1), $L_2=L_1+2\times D_3$.

Preferably, overall, end-to-end longitudinal (Z-axis) length ($L_2$) of a lighting fixture having one illumination sub-assembly 110 (see FIG. 4A) is about 305 mm, but the length can be any suitable dimension. For lighting fixtures of such dimensions, the overall, end-to-end longitudinal (Z-axis) length of the substrate 112 of each illumination sub-assembly 110 is preferably about 300 mm, but other lengths are suitable for lighting fixtures of different lengths.

A maximal (X-axis) width (W) of the lighting fixture 12 (see FIG. 4A) is preferably about 25 mm, but other widths are also suitable.

A maximal (Y-axis) height (H) of the lighting fixture (including the cover 52) (see FIG. 4B) is preferably about 20 mm, but other heights are possible.

The end spacing distance $D_2$ (see FIG. 2) is preferably about 20 mm, but other spacing is possible.

The spacing interval (S) (see FIG. 2) is preferably about 51 mm, but other spacing may be suitable.

As stated above, the gap (G) between lighting fixtures connected via the minimal spacing, in-line inter-connector 26 is preferably about 0-10 mm. Therefore, the gap between such interconnected lighting fixtures is preferably about 0% to about 5% of the overall, end-to-end longitudinal (Z-axis) length ($L_2$) of a lighting fixture having one illumination sub-assembly. For lighting fixtures having multiple illumination sub-assemblies, the ration of the gap to the overall length ($L_2$) can be proportionately smaller.

Figure 10:
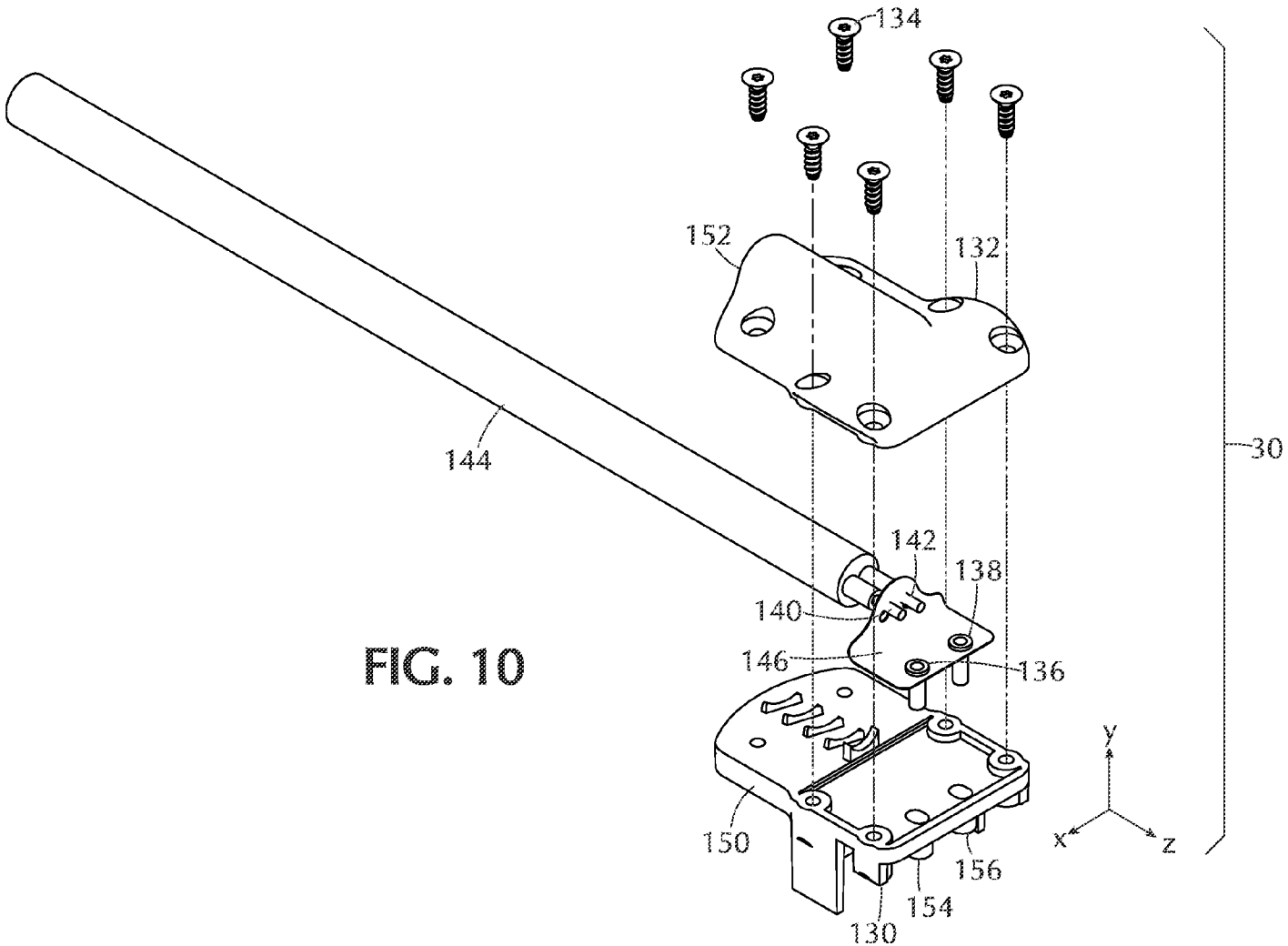
FIG. 10 is an exploded, perspective view of the extended, in-line inter-connector shown in FIG. 1A.

Referring to FIGS. 1A and 10, as discussed above, the lighting system preferably includes the extended, in-line inter-connector 30 for interconnecting lighting fixtures (or segments of one or more lighting fixtures) spaced a substantial distance apart, for example 1 meter or more. The extended, in-line inter-connector 30 preferably includes a base part 130 and a cover part 132, which are similar in configuration in many respects to the base part 80 and cover part 82 of the minimal spacing, in-line inter-connector 26. Likewise, the base part 130 and cover part 132 of the inter-connector 30 can be assembled by screws 134 or other suitable fasteners. The inter-connector 30 includes two electrical connectors 136, 138, which are preferably female-type connectors. Each electrical connector 136, 138 is electrically connected to one of two wires 140, 142 of a flexible cord 144 extending outwardly from the base and cover parts. Each electrical connector 136, 138 is preferably connected to one of the wires 140, 142 of the flexible cord 144 via a flexible circuit 146, or another type of connection. The base and cover portions 130, 132 can include strain relief portions 150, 152 extending longitudinally (parallel to the Z-axis) therefrom, which clamp and secure the terminal end portion of the flexible cord 144.

The base part 130 of the inter-connector 30 includes two connector shrouds 154, 156 extending downwardly from a bottom of the base part 130 and configured to receive, surround and shroud the electrical connectors 136, 138. The connector shrouds 154, 156 are arranged and configured to be received within the contact openings 66, 68 of the end caps 56 of the lighting fixture 12 (see FIG. 6) such that the electrical connectors 136, 138 within the connector shrouds 154, 156 can electrically engage the electrical connectors 22, 24 of the lighting fixture.

The extended, in-line inter-connector 30 is removably connectable to a lighting fixture 12 from the "top" of the lighting fixture in a direction parallel to the normal axis (Y), in a manner similar to that of the minimal spacing, in-line connector 28.

Figure 11:
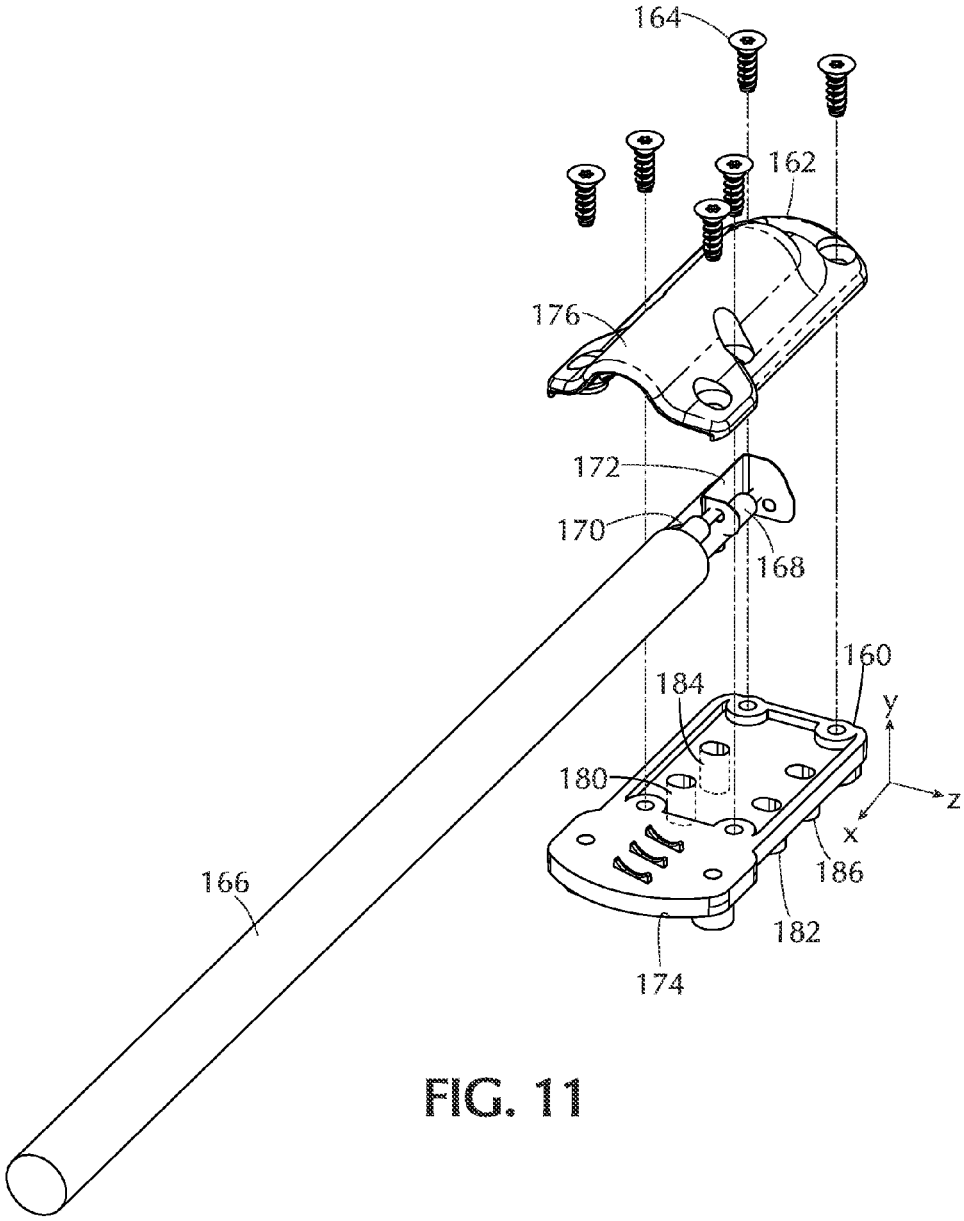
FIG. 11 is an exploded, perspective view of mid-feed inter-connector shown in FIG. 1B.
Figure 12A:
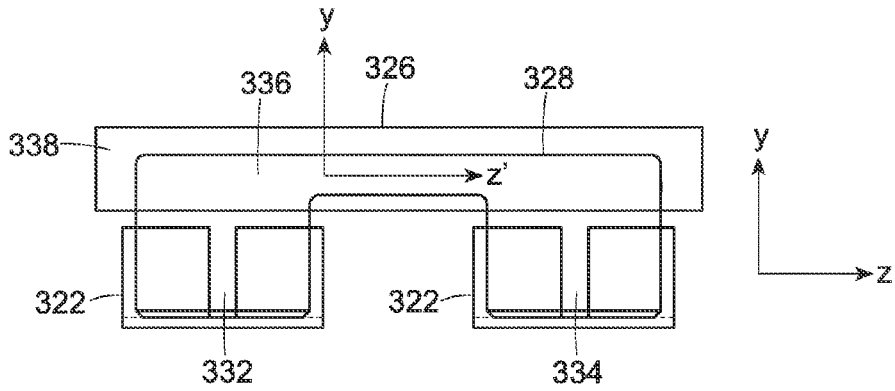
FIG. 12A is a side elevation view of an alternative minimal space, in-line inter-connector showing a knife-blade connector thereof seated in jaw-type connectors.
Figure 12B:
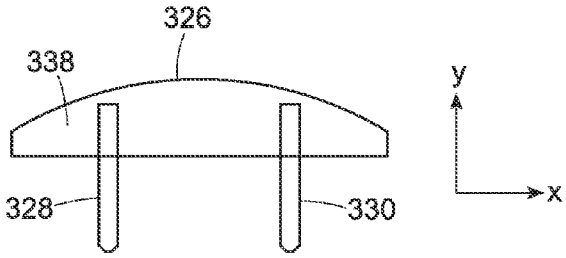
FIG. 12B is an end elevation view of the inter-connector of FIG. 12A.
Figure 12C:
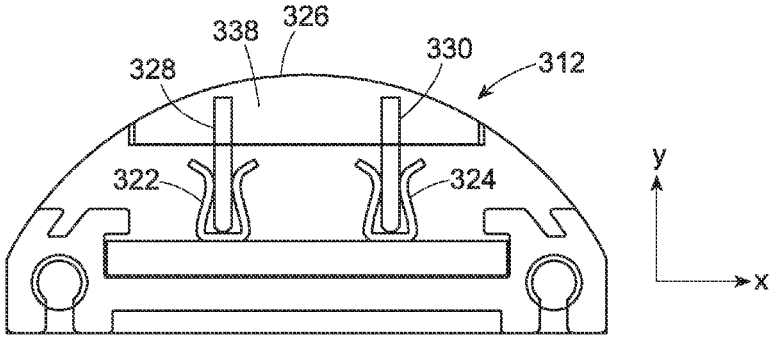
FIG. 12C is an cross-section, end elevation view of the inter-connector of FIG. 12A connected to a lighting fixture.
Figure 12D:
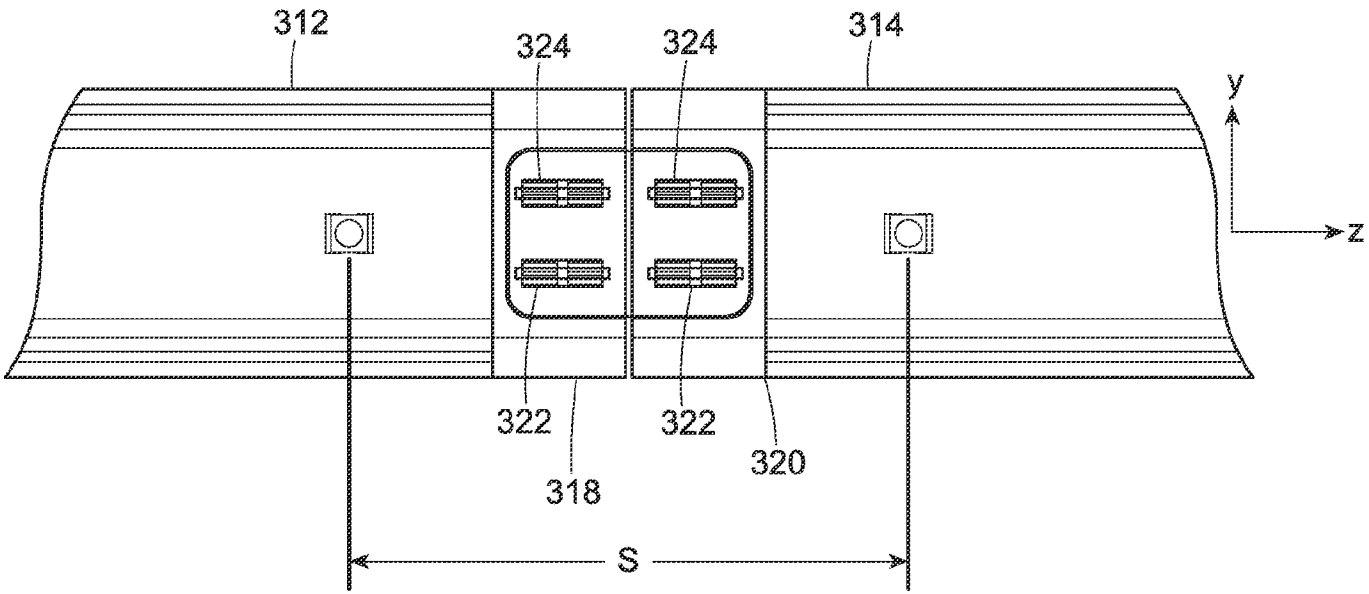
FIG. 12D is a top plan view of the inter-connector of FIG. 12A connected to two lighting fixtures.

Referring to FIGS. 1B and 11, as discussed above, the lighting system preferably includes the mid-feed inter-connector 32 for interconnecting lighting fixtures (or segments of one or more lighting fixtures) to an intermediate portion of string of lighting fixtures to, for example, create a second branch of the lighting system. The mid-feed inter-connector 32 preferably includes a base part 160 and a cover part 162, which are similar in many respects to the base part 80 and cover part 82 of the minimal spacing, in-line inter-connector 26. Likewise, the base part 160 and cover part 162 of the mid-feed inter-connector 32 can be assembled by screws 164 or other suitable fasteners.

The mid-feed inter-connector 32 includes the same configuration of electrical connectors (not shown) and connector shrouds as the minimal spacing, in-line connector 26, described above, such that it can interconnect and pass power between adjacent lighting fixtures arranged in-line with the adjacent ends 18, 20 thereof at the minimal spacing distance, in the same manner as the minimal spacing, in-line connector 26. Furthermore, the mid-feed inter-connector 32 and the minimal spacing, in-line connector 26 are interchangeable in a lighting installation without dismounting or disturbing any of the lighting fixtures.

The mid-feed inter-connector includes a flexible cord 166 having a pair of wires 168, 170. Each wire 168, 170 is connected to one of the first and second pairs of electrical connectors (not shown, see FIG. 5), for example via a flexible circuit 172, such that the wires 168, 170 can draw power from one segment of the lighting installation to provide power to another segment or branch of the installation. The base and cover portions 160, 162 can include strain relief portions 174, 176 extending laterally (parallel to the X-axis) therefrom, which clamp and secure the terminal end portion of the flexible cord 166.

As with the minimal-spacing, in-line inter-connector 26, in the mid-feed inter-connector 32, the connectors of the first and second pairs of electrical connectors (not shown) are preferably female-type connectors and are preferably interconnected by a flexible printed circuit board (not shown), or any other suitable means to electrically interconnect the paired connectors.

The base part 160 includes first and second pairs of connector shrouds 180, 182 and 184, 186 extending downwardly from a bottom of base part 160 and configured to receive, surround and shroud the electrical connectors. The connector shrouds 180, 182 and 184, 186 are arranged and configured to be received within the contact openings 66, 68 of the end caps 56 of the lighting fixture 12 such that the electrical connectors within the connector shrouds 180, 182 and 184, 186 can electrically engage the electrical connectors 22, 24 of the lighting fixture.

When two lighting fixtures 12, 14 are mounted in-line with adjacent ends 18, 20 thereof at the minimal spacing distance, there is preferably no gap or a minimal gap between the ends 18, 20 of the lighting fixtures 12, 14, and the lighting fixtures 12, 14 can be interconnected using the mid-feed inter-connector 32. As discussed above, the mid-feed inter-connector 32 can be installed and removed from the "top" of the lighting fixtures 12, 14 in a direction parallel to the normal axis (Y). When installed, the mid-feed inter-connector 32 electrically connects opposed pairs of electrical contacts of the adjacent lighting fixtures 12, 14 to provide power between the lighting fixtures.

The centers of the connectors of each pair of electrical connectors of the mid-feed inter-connector 32 (and the centers of the shrouds of each pair of connector shrouds 180, 182 and 184, 186 thereof) are spaced apart a longitudinal (i.e., Z-axis) distance ($D_1$) (the connector span distance) which is equal to a longitudinal distance ($D_1$) between opposed electrical connectors of adjacent lighting fixtures 12, 14, when the lighting fixtures 12, 14 are mounted in-line with adjacent ends 18, 20 thereof at the minimal spacing distance.

As with the minimal spacing, in-line inter-connector 26, when the mid-fee inter-connector 32 is installed, preferably no portion of the inter-connector 32 is disposed between the adjacent lighting fixtures 12, 14. Thus, the lighting fixtures can be arranged in a closely abutting relationship (i.e. no gap or minimal gap), which avoids dark spots between lighting fixtures.

Referring again to FIGS. 2, 3 and 4A-4C, the base 40 of the lighting fixture 12 preferably includes first and second integrally-formed, opposed rails 190, 192 each having a cover-receiving channel 194, 196 formed therein, which is configured to slidably receive and confine (at least in the (X) and (Y) directions) an edge of the cover 52 for the lighting fixture 12. Each rail 190, 192 also has an inwardly-facing substrate-receiving channel 200, 202 configured to slidably receive and confine (at least in the (X) and (Y) directions) an edge of the substrate 112 of the illumination sub-assembly 110. To assemble the lighting fixture 12, one or more illumination sub-assemblies 110 are inserted into one end of the base 40 by sliding the substrate 112 thereof into the channels 200, 202 of the base 40. Prior to or after insertion of each illumination sub-assemblies 110 into the base, the sub-assemblies are joined by mounting an intra-fixture connector 120 to adjacent sub-assemblies. Preferably, the cover 52 is then slidably inserted into the slots 194, 196. Thereafter, the end caps 56 are fixed to each end of the lighting fixture to complete the assembly process of the lighting fixture.

While the substrate 112 of each illumination sub-assembly within a lighting fixture is confined by the base 40 and the channels 200, 202 thereof, the substrates 112 can preferably move relative to the base (at least in the (Z) direction) to accommodate differing rates and amounts of thermal expansion/contraction of the substrate 112 and the base 40.

Referring to FIGS. 12A, 12B, 12C and 12D, in an alternate embodiment of the lighting system, each lighting fixture 312, 314 includes a pair of upwardly open, jaw-type electrical connectors 322, 324 adjacent the ends 318, 320 of each lighting fixture 312, 314. A longitudinal axis (z) of each jaw-type connector 322, 324 is preferably parallel to the longitudinal axis (Z) of the associated lighting fixture 312, 324.

In this alternate embodiment, the minimal spacing, in-line inter-connector 326 has a pair of knife-blade type electrical connectors 328, 330, each having a pair of contact portions

332, 334 interconnected by and depending downwardly (Y-axis) from a bridge portion 336. Each contact portion 332, 334 is adapted to engage one of the jaw-type connectors 322, 324 of the lighting fixtures 312, 314. The bridge portion 336 is preferably molded into or affixed to a cover portion 338, with the contact portions 332, 334 exposed and extending downwardly (Y-axis) from the cover portion 338.

The knife-blade connectors have a longitudinal axis (Z') that is aligned parallel to the longitudinal axis (Z) of the lighting fixtures 312, 314 when the inter-connector 326 is mounted thereto. The knife-blade and jaw-type connectors provide efficiency in parts and manufacturing and can more efficiently accommodate thermal expansion and contraction of the lighting fixtures or the illumination sub-assemblies 112 thereof because the jaws and knife blades are aligned with the long (Z) axis of the lighting fixtures, which is the primary axis for thermal expansion and contraction.

The modular lighting system described above is based on a 2-wire system. However, the invention also encompasses lighting systems with 1 wire, 3 wires, or more than 3 wires. For example, in a 1-wire system, each lighting fixture could include a single contact at each end and multiple lighting fixture could be connected in series with a power source, such as a constant current power source. Alternatively, in a system with more than 3 wires, a pair of contacts could be used for power (e.g., positive and negative) and the other contact could be used for ground. In systems with more than 3 wires, the additional contacts could be used for ground and control signals. The lighting system of the invention could operate at any suitable voltage level, including 12VDC, 24VDC, 24VAC, 120VAC, 277VAC, or any other suitable voltage level.

Although the invention has been described with reference to a particular arrangement of parts, features and the like, these are not intended to exhaust all possible arrangements or features, and indeed many modifications and variations will be ascertainable to those of skill in the art.

What is claimed is:

1. A modular lighting system comprising:

(a) first and second lighting fixtures adapted for end-to-end electrical interconnection, each lighting fixture including
  (i) first and second ends;
  (ii) at least one electrical connector adjacent each of the first and second ends;
  (iii) means for illumination; and
  (iv) a longitudinal axis passing through the first and second ends;

(b) a first electrical inter-connector removably connected to the first and second lighting fixtures and electrically interconnecting at least one of the electrical connectors of the first lighting fixture to at least one of the electrical connectors of the second lighting fixture; and (c) the first electrical inter-connector being connectable to at least one of the first and second lighting fixtures by moving the electrical inter-connector relative to the one lighting fixture in a first direction substantially perpendicular to the longitudinal axis of the one lighting fixture.

2. A modular lighting system as in claim 1, wherein:

(a) each lighting fixture has a base defining a mounting plane; and (b) the first direction is substantially normal to the mounting plane.

3. A modular lighting system as in claim 2, wherein:

(a) the longitudinal axis and the mounting plane are substantially parallel.

4. A modular lighting system as in claim 3, wherein:

(a) the first and second lighting fixtures are mounted to the support structure with the longitudinal axes thereof in alignment and with one of the ends of the first lighting fixture closely abutting one of the ends of the second lighting fixture; and (b) the first electrical inter-connector is disconnectable from both of the first and second lighting fixtures without disturbing the first or second lighting fixtures.

5. A modular lighting system as in claim 4, further comprising:

(a) a third lighting fixture adapted for end-to-end electrical interconnection, the third lighting fixture including
  (i) first and second ends;
  (ii) at least one electrical connector adjacent each of the first and second ends;
  (iii) means for illumination;
  (iv) a longitudinal axis passing through the first and second ends;
  (v) a base defining a mounting plane; and
  (vi) the mounting plane of the base and the longitudinal axis being substantially parallel;

(b) the third lighting fixture being mounted to the support structure with the longitudinal axis thereof in alignment with the longitudinal axes of the first and second lighting fixtures and with one of the ends of the third lighting fixture closely abutting one of the ends of the second lighting fixture, such that the second lighting fixture is intermediate the first and third lighting fixtures;

(c) a second electrical inter-connector removably connected to the second and third lighting fixtures and electrically interconnecting at least one of the electrical connectors of the second lighting fixture to at least one of the electrical connectors of the third lighting fixture;

(d) the second electrical inter-connector being connectable to the second and third lighting fixtures by moving the electrical inter-connector relative to the second and third lighting fixtures in a direction substantially parallel to the first direction;

(d) the second electrical inter-connector is disconnectable from both of the second and third lighting fixtures without disturbing the second or third lighting fixtures; and (e) upon disconnection of the first electrical inter-connector from the first and second lighting fixtures and the second electrical inter-connector from the second and third lighting fixtures, the second lighting fixture being dismountable from the support structure without dismounting the first or third lighting fixtures.

6. A modular lighting system as in claim 1, wherein:

(a) each of the first and second lighting fixtures has a plurality of illumination elements disposed along a longitudinal length of the lighting fixture, with the illumination elements spaced apart a predetermined spacing interval; and (b) the first lighting fixture has an end-most illumination element closest to the second lighting fixture and the second lighting fixture has an end-most illumination element closest to the first lighting fixture;

(c) the first and second lighting fixtures are mounted to the support structure with the longitudinal axes thereof in alignment and with one of the ends of the first lighting fixture closely abutting one of the ends of the second lighting fixture;

(d) a distance between the end-most illumination element of the first lighting fixture and the end-most illumination element of the second lighting fixture being substantially equal to the spacing interval.

7. A modular lighting system as in claim 1, wherein:

(a) the first lighting fixture has first and second illumination sub-assemblies, the first and second illumination sub-assemblies being electrically inter-connected by an intra-fixture connector within the first lighting fixture, in an end-to-end fashion;

(b) each illumination sub-assembly has a plurality of illumination elements disposed along a longitudinal length thereof, with the illumination elements spaced apart a predetermined spacing interval; and (c) the first illumination sub-assembly has an end-most illumination element closest to the second illumination sub-assembly and the second illumination sub-assembly has an end-most illumination element closest to the first lighting fixture; and (d) a distance between the end-most illumination element of the first lighting fixture and the end-most illumination element of the second lighting fixture being substantially equal to the spacing interval.

8. A modular lighting system, comprising:

(a) first and second lighting fixtures adapted for end-to-end electrical interconnection, each lighting fixture including (i) first and second ends;

(ii) at least one electrical connector adjacent each of the first and second ends;

(iii) means for illumination; and (iv) a longitudinal axis passing through the first and second ends;

(b) the first and second lighting fixtures being mounted to a support structure with the longitudinal axes thereof in alignment and with one of the ends of the first lighting fixture closely abutting one of the ends of the second lighting fixture;

(c) a first electrical inter-connector removably connected to the first and second lighting fixtures and electrically interconnecting at least one of the electrical connectors of the first lighting fixture to at least one of the electrical connectors of the second lighting fixture; and (d) the first electrical inter-connector being connectable to and disconnectable from the first and second lighting fixtures without dismounting the first and second lighting fixtures from the support structure.

9. A modular lighting system, as in claim 8, further comprising:

(a) a third lighting fixture adapted for end-to-end electrical interconnection, the third lighting fixture including (i) first and second ends;

(ii) at least one electrical connector adjacent each of the first and second ends;

(iii) means for illumination; and (iv) a longitudinal axis passing through the first and second ends;

(b) the third lighting fixture being mounted to the support structure with the longitudinal axis thereof in alignment with the longitudinal axes of the first and second lighting fixtures and with one of the ends of the third lighting fixture closely abutting one of the ends of the second lighting fixture, such that the second lighting fixture is intermediate the first and third lighting fixtures;

(c) a second electrical inter-connector removably connected to the second and third lighting fixtures and electrically interconnecting at least one of the electrical connectors of the second lighting fixture to at least one of the electrical connectors of the third lighting fixture;

(d) the second electrical inter-connector being connectable to and disconnectable from both of the second and third lighting fixtures without disturbing the second or third lighting fixtures; and (e) upon disconnection of the first electrical inter-connector from the first and second lighting fixtures and the second electrical inter-connector from the second and third lighting fixtures, the second lighting fixture being dismountable from the support structure without dismounting the first or third lighting fixtures.

* * * * *